US007017379B1

(12) United States Patent
Hsieh

(10) Patent No.: US 7,017,379 B1
(45) Date of Patent: Mar. 28, 2006

(54) REMOTE-CONTROLLED BURGLARY PREVENTING DOOR LOCK

(76) Inventor: Hui-Hua Hsieh, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 10/992,649

(22) Filed: Nov. 22, 2004

(51) Int. Cl.
*E05B 47/06* (2006.01)

(52) U.S. Cl. ..... 70/257; 70/278.7; 70/279.1; 70/283; 70/DIG. 63; 292/144

(58) Field of Classification Search ..... 70/256, 70/257, 279.1, DIG. 63, 278.7, 278.3, 277, 70/280–283, 283.1; 292/144
See application file for complete search history.

(56) References Cited

U.S. PATENT DOCUMENTS 1,816,504 A * 7/1931 Ulrich ..... 70/262
1,970,807 A * 8/1934 Lovell ..... 292/165
2,028,852 A * 1/1936 Vincent ..... 70/262
2,031,523 A * 2/1936 Braren ..... 70/283
2,103,702 A * 12/1937 Tibbetts ..... 292/164
2,299,646 A * 10/1942 Muller ..... 70/283
2,638,772 A * 5/1953 Ramler ..... 70/151 R
3,157,042 A * 11/1964 Wolz ..... 70/279.1
4,685,709 A * 8/1987 Kambic ..... 292/201
4,944,170 A * 7/1990 Jolidon et al. ..... 70/267
5,010,751 A * 4/1991 Schwartz et al. ..... 70/276
5,760,703 A * 6/1998 Becker ..... 340/825.67
6,079,755 A * 6/2000 Chang ..... 292/144
6,584,817 B1 * 7/2003 Lien ..... 70/277
6,658,905 B1 * 12/2003 Hsieh ..... 70/279.1
6,666,054 B1 * 12/2003 Hsieh ..... 70/257
6,698,263 B1 * 3/2004 Hsieh ..... 70/257
6,845,641 B1 * 1/2005 Hsieh ..... 70/257

* cited by examiner

*Primary Examiner*—Lloyd A. Gall

(57) ABSTRACT

A remote-controlled burglary preventing door lock includes a motor to be started by a remote controller to rotate reversely and drive a cam disk to rotate counterclockwise and actuate the upper end of a blocking pin to move downward and disengage from the stop rod at the inner end of a deadbolt, letting the deadbolt no longer blocked by the blocking pin. Thus, the door lock can be unlocked. To lock the door lock, the motor is started by a remote controller to rotate clockwise and drive the cam disk to rotate clockwise and actuate the upper end of the blocking pin to move upward and block the rear side of the stop rod at the inner end of the deadbolt, letting the deadbolt blocked by the blocking pin and impossible to retract toward the interior of a lock shell, having an excellent effect of burglary prevention.

2 Claims, 9 Drawing Sheets

REMOTE-CONTROLLED BURGLARY PREVENTING DOOR LOCK

BACKGROUND OF THE INVENTION

1. Field of the Invention

This invention relates to a remote-controlled burglary preventing door lock, particularly to one provided with a motor to be started by a remote controller. When the motor is started to rotate reversely and drive a cam disk on a spindle to rotate counterclockwise and actuate a blocking pin to move downward and have its upper end disengaged from a stop rod at the inner end of a deadbolt, letting the deadbolt no longer blocked by the blocking pin and able be retracted toward the lock shell by a key to finish unlocking of the door lock. To lock the door lock, the motor is started by the remote controller to rotate clockwise and drive the cam disk to rotate in the same direction. Synchronously, the cam disk actuates the blocking pin to move upward and have its upper end blocking the rear side of the stop rod at the inner end of the deadbolt, letting the deadbolt blocked by the blocking pin and unable to retract toward the lock shell. Thus, a door lock is impossible to be unlocked by a key or by other unlocking tools before it is released by a remote controller, achieving an excellent effect of burglary prevention.

2. Description of the Prior Art

A conventional door lock, as shown in FIG. 1, includes a housing 10 disposed inside with a lock base 11, which has one side provided with lock rods 111 able to extend out of an insert holes 100 bored at the sidewall of the housing 10 and be engaged in the long engage groove 141 in the sidewall of the latch base 140 of a door jamb 14. The lock base 11 is further provided with a lock core 111 with a keyhole 112 respectively at the inner and the outer side. A pull plate 12 is fitted in the inner side of the housing 10, having a fixing plate 120 inserted in the guide rail 101 of the housing 10 and positioned opposite to the fixing plate 102 of the housing 10. The housing 10 is further provided inside with a deadbolt 13 having its inner end inserted through the fixing plate 102 of the housing 10 and secured with the fixing plate 120 of the pull plate 12, with a spring 130 fitted around one end of the deadbolt 13 near the pull plate 12. The deadbolt 13 has its outer end fixed with a stopper 131 able to extend out of the through hole 103 at the sidewall of the housing 10 and be engaged in the long engage groove 141 at the sidewall of the latch base 140 of a doorjamb 14. Thus, when a key is inserted in the keyhole 112 of the lock core 111 and turned around to force the lock rods 110 and the stopper 131 to retract toward the housing 10 and disengage from the long engage groove 141 of the latch base 140 of the doorjamb 14, the door lock can be unlocked. However, a conventional door lock has its lock rods 110 locked only by a key so it can easily be pried unlocked by a burglary with unlocking tools, hardly having effect of burglary prevention.

SUMMARY OF THE INVENTION

The objective of the invention is to offer a remote-controlled burglary preventing door lock, which is locked or unlocked by a remote controller, having an excellent effect of burglary prevention.

A first feature of the invention is a lock shell disposed inside with an interacting member having a push plate fixed thereon. The push plate has its upper end connected with a deadbolt, which has its outer end extending out of the outer sidewall of the lock shell and its inner end secured with a stop rod. The lock shell is further provided with an insert hole and fixing studs. A motor is installed on the lock shell, and a cam disk is positioned in the interior of the lock shell, having a shaft hole and an arc-shaped slide groove. A blocking pin is combined on the cam disk and has its lower end formed with a projecting stud inserted in the slide groove of the cam disk. A fixing member is fastened with the fixing studs in the lock shell and bored with a vertical insert slot for the blocking pin to be inserted therethrough. A cover provided with a lock core is assembled on the lock shell.

A second feature of the invention is a lock shell provided in the interior with an interacting member having a push plate fixed thereon. The push plate has its upper end connected with a deadbolt, which has its outer end extending out of the outer side wall of the lock shell and its inner end fixed with a stop rod. The lock shell is further provided with two locking rods inside one sidewall and has an insert hole and fixing studs provided in the interior. A motor is assembled on the lock shell, and a cam disk is installed in the lock shell and provided with a shaft hole and a projection. A connecting rod has one end fixed on the cam disk and has the opposite ends respectively bored with an insert hole. A blocking pin is pivotally connected with the other end of the connecting rod, having a projecting stud formed at the lower end. A fixing member is secured on the fixing studs in the lock shell, having a vertical insert slot for the blocking pin to be inserted therethrough. A cover provided thereon with a lock core is assembled on the lock shell.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
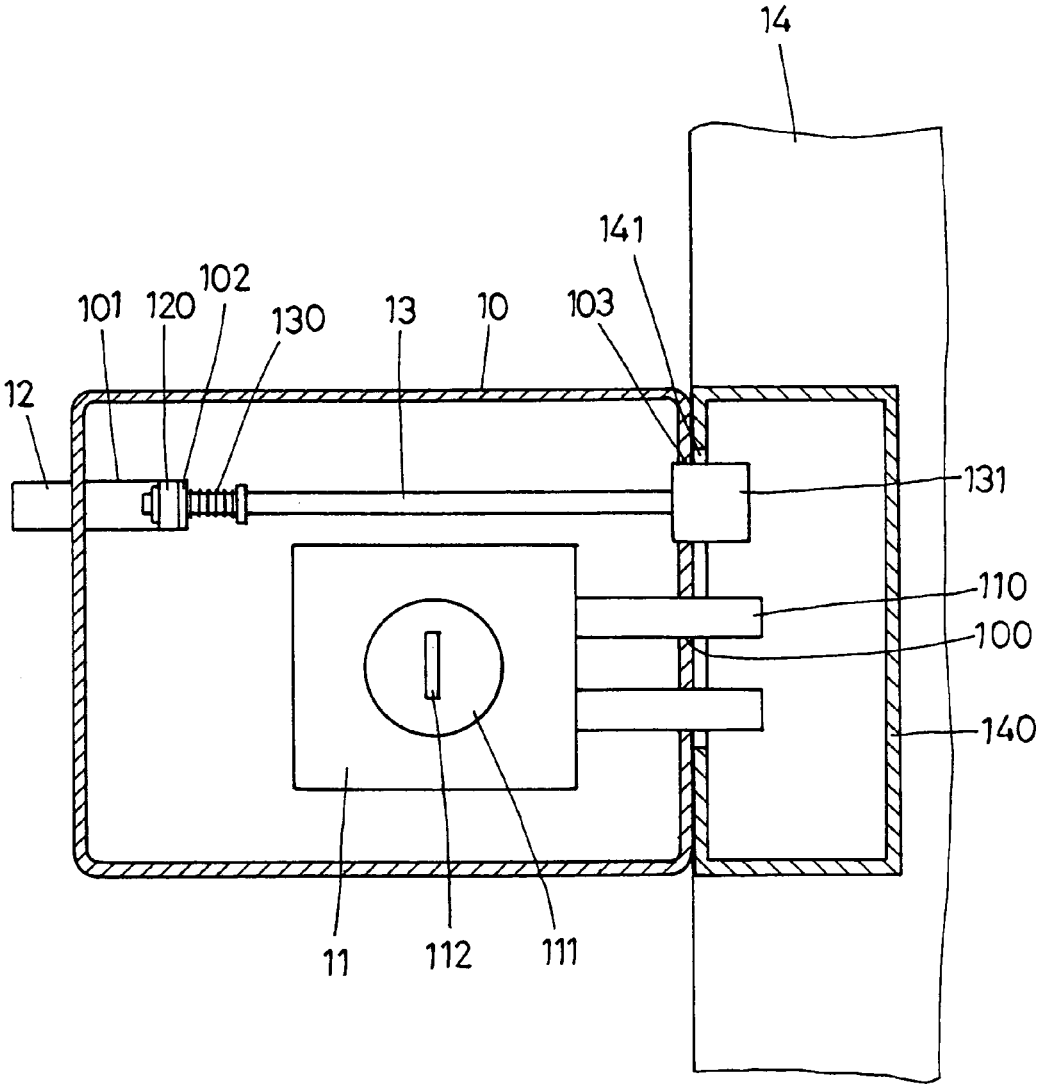
FIG.1 (PRIOR ART)
FIG. 1 is a cross-sectional view of a conventional door lock.
Figure 2:
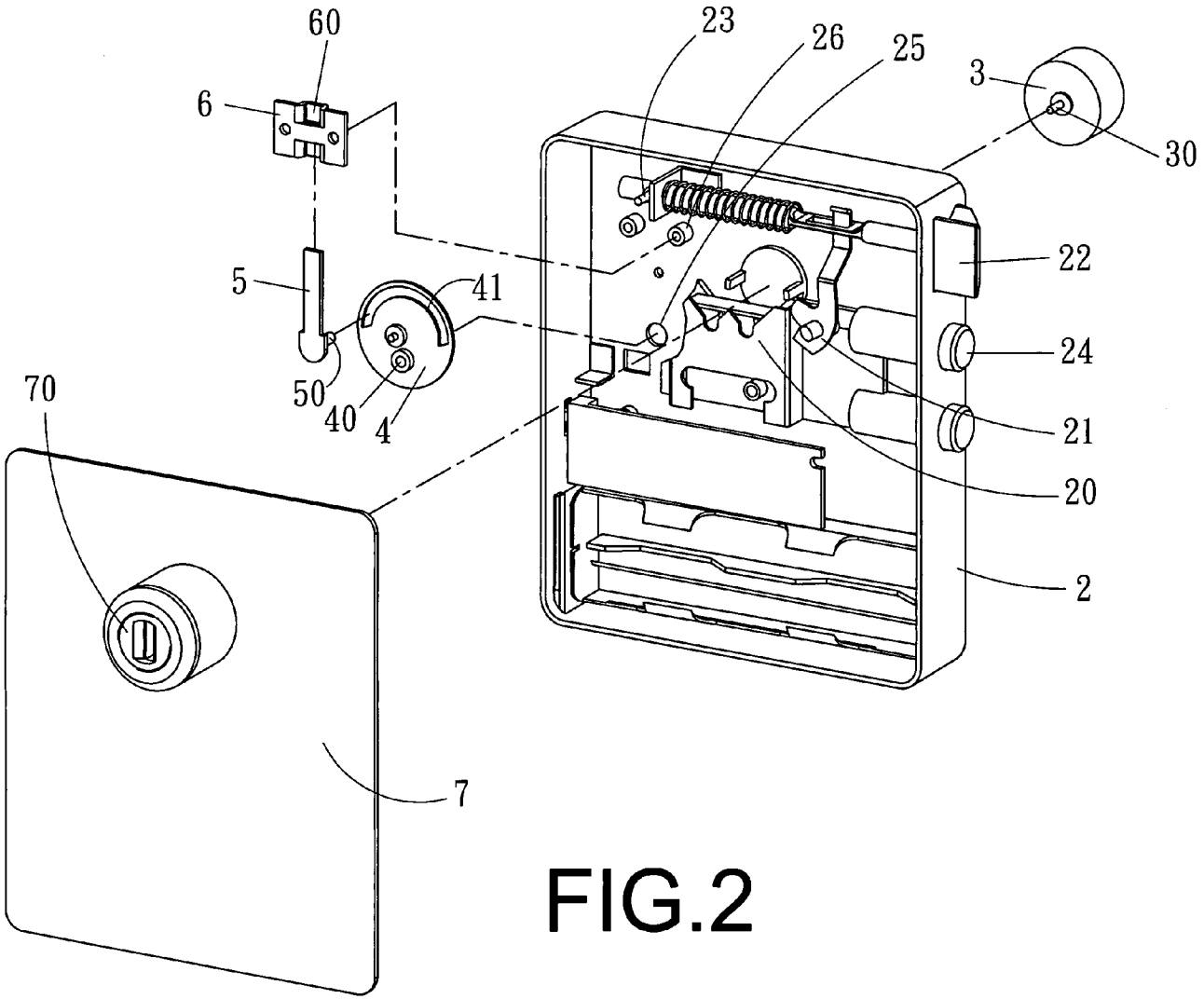
FIG. 2 is an exploded perspective view of a first preferred embodiment of a remote-controlled door lock in the present invention.

A first preferred embodiment of a remote-controlled burglary preventing door lock in the present invention, as shown in FIG. 2, includes a lock shell 2, a motor 3, a cam disk 4, a blocking pin 5, a fixing member 6 and a cover 7 as main components combined together.

The lock shell 2 is provided inside with an interacting member 20 having a push plate 21 fixed thereon. The push plate 21 has its upper end connected with a deadbolt 22, which has its outer end extending out of the outer sidewall of the lock shell 2 and its inner end secured with a stop rod. Further, the lock shell 2 is provided with two locking rods 24 inside one sidewall, and has an insert hole 25 and two fixing studs 26 provided inside.

The motor 3 is assembled on the outer wall of the lock shell 2, having its spindle 30 inserted through the insert hole 25 of the lock shell 2.

The cam disk 4 disposed in the lock shell 2 is bored with a shaft hole 40 and an arc-shaped slide groove 41.

The blocking pin 5 is fixed with the cam disk 4 and has its lower end formed with a projecting stud 50.

The fixing member 6 is secured on the fixing studs 26 in the lock shell 2, having a vertical insert slot 60 for the blocking pin 5 to be inserted therethrough.

The cover 7 assembled on the locking shell 2 is provided thereon with a lock core 70.

Figure 3:
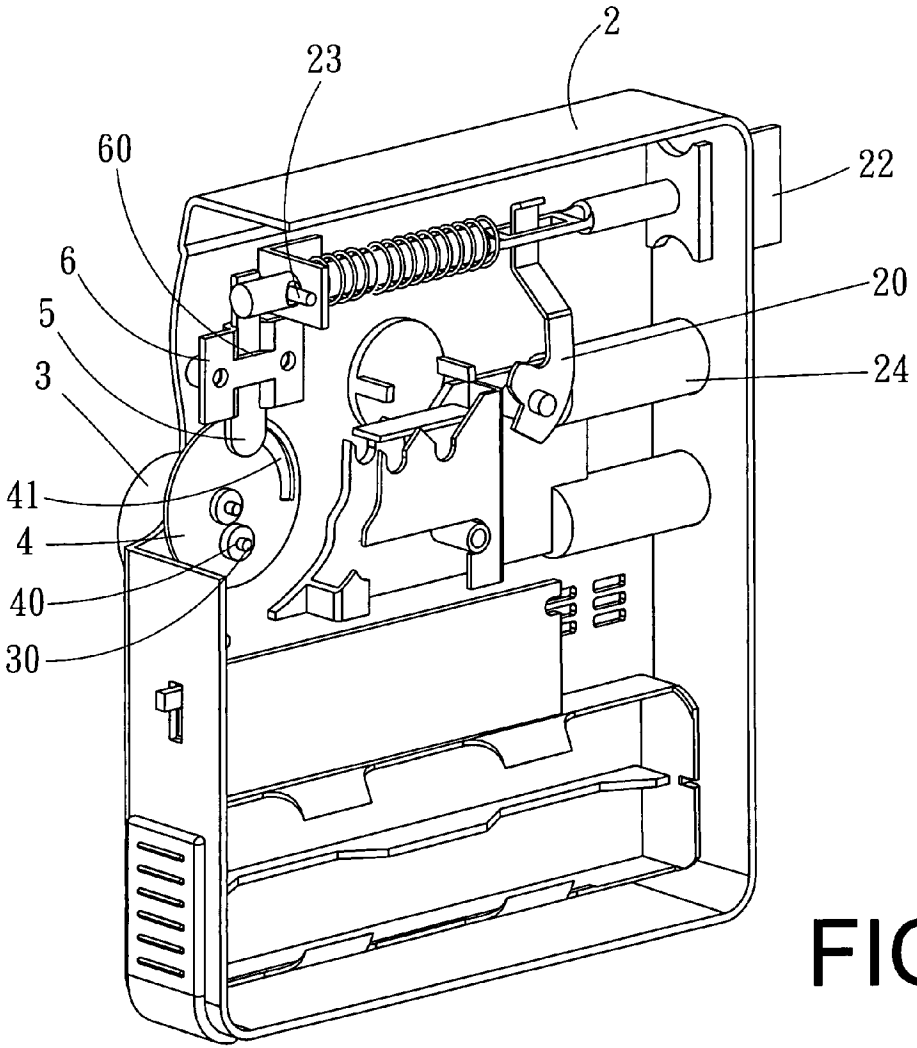
FIG. 3 is a perspective view of the first preferred embedment of the remote-controlled door lock in the present invention.
Figure 4:
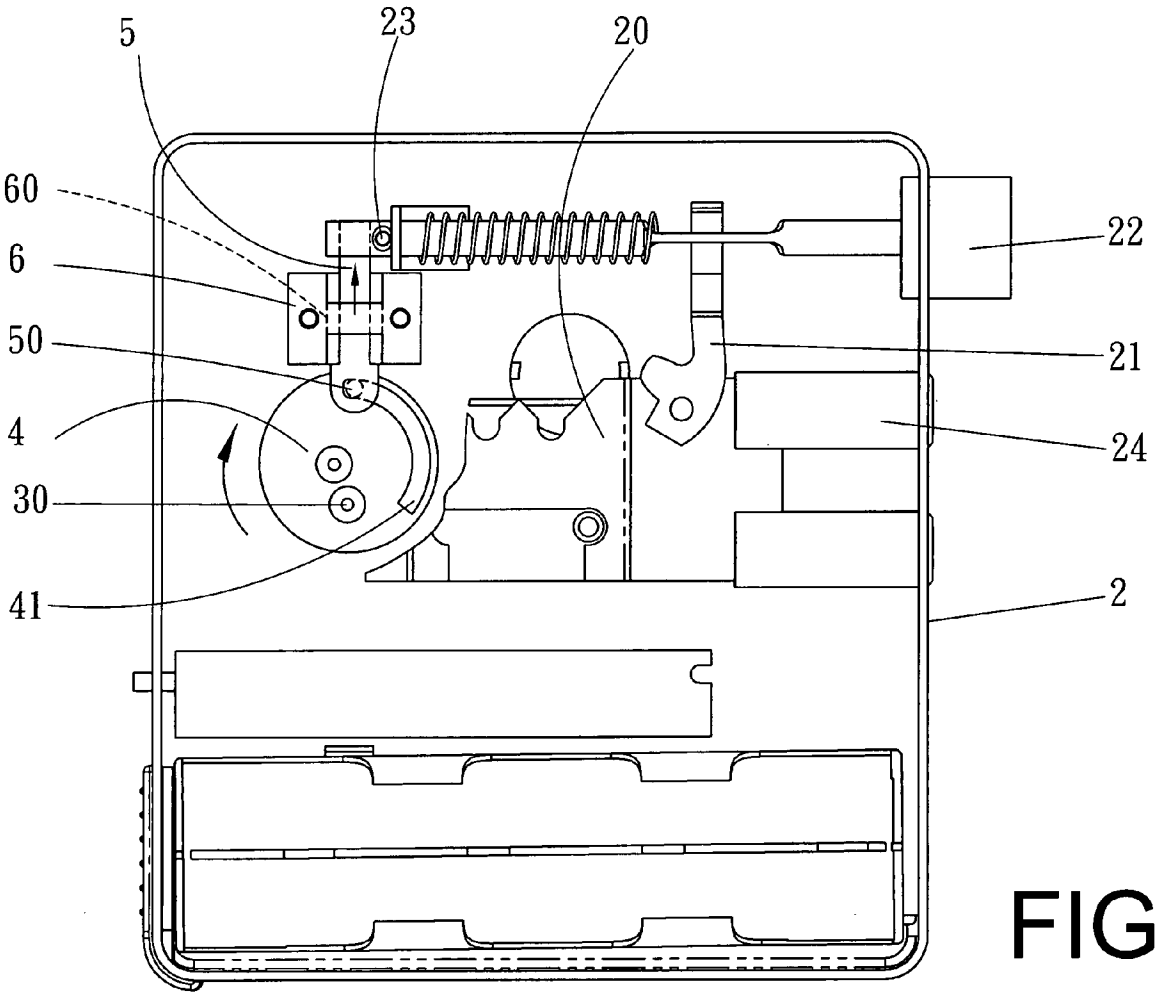
FIG. 4 is a cross-sectional view of the first preferred embodiment of the remote-controlled door lock in a locking condition in the present invention.

In assembling, as shown in FIGS. 2, 3 and 4, firstly, the motor 3 is fixed on the outer side wall of the lock shell 2, letting the spindle 30 of the motor 3 inserted through the insert hole 25 of the lock shell 2. Next, the cam disk 4 is secured on the spindle 30 in the lock shell 2, and the fixing member 6 are firmly combined with the fixing studs 26 in the lock shell 2 and then the blocking pin 5 has its upper end inserted through the vertical insert slot 60 of the fixing member 6. Lastly, the cover 7 is assembled on the lock shell 2 and has its lock core 70 connected with the interacting member 20, thus finishing assembly of the door lock.

Figure 5:
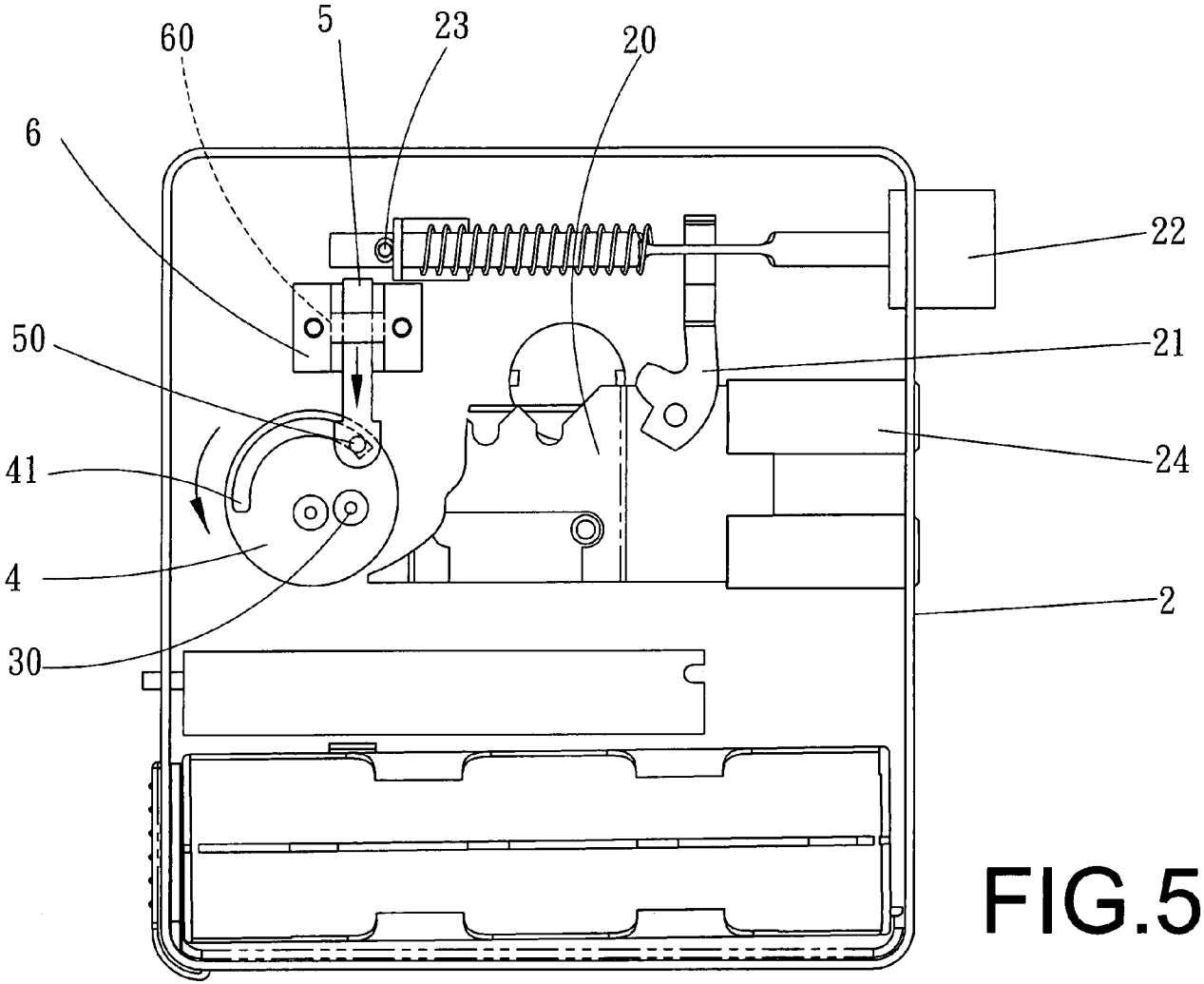
FIG. 5 is a cross-sectional view of the first preferred embodiment of the remote-controlled door lock in an unlocking condition in the present invention.

To unlock the door lock, as shown in FIG. 5, the motor 3 is started by a remote controller to rotate reversely and the cam disk 4 on the spindle 30 of the motor 3 is driven to rotate counterclockwise. Synchronously, the projecting stud 50 of the blocking pin 5 on the cam disk 4 slides in the arc-shaped slide groove 41 of the cam disk 4 and the blocking pin 5 is actuated by the cam disk 4 to move downward and have its upper end disengaged from the stop rod 23 at the inner end of the deadbolt 22, letting the deadbolt 22 no longer blocked by the blocking pin 5. At this time, have a key inserted in the lock core 70 and turned around to let the lock core 70 drive the interacting member 20 to move inward and relieve the locking rods 24 and simultaneously actuate the push plate 21 to turn and actuate the deadbolt 22 to retract toward the interior of the lock shell 2.

To lock the door lock, as shown in FIG. 4, the motor 3 is started by the remote controller to rotate clockwise and drive the cam disk 4 to rotate in the same direction and actuate the projecting stud 50 of the blocking pin 5 to slide in the arc-shaped slide groove 41. When the blocking pin 5 is actuated by the cam disk 4 to move upward and have its upper end blocking the rear side of the stop rod 23 at the inner end of the deadbolt 22, the deadbolt 22 is blocked by the blocking pin 5 and impossible to be retracted toward the interior of the lock shell 2. Thus, the door lock is impossible to be unlocked only by a key or by other unlocking tools before it is released by a remote controller, having an excellent effect of burglary prevention.

Figure 6:
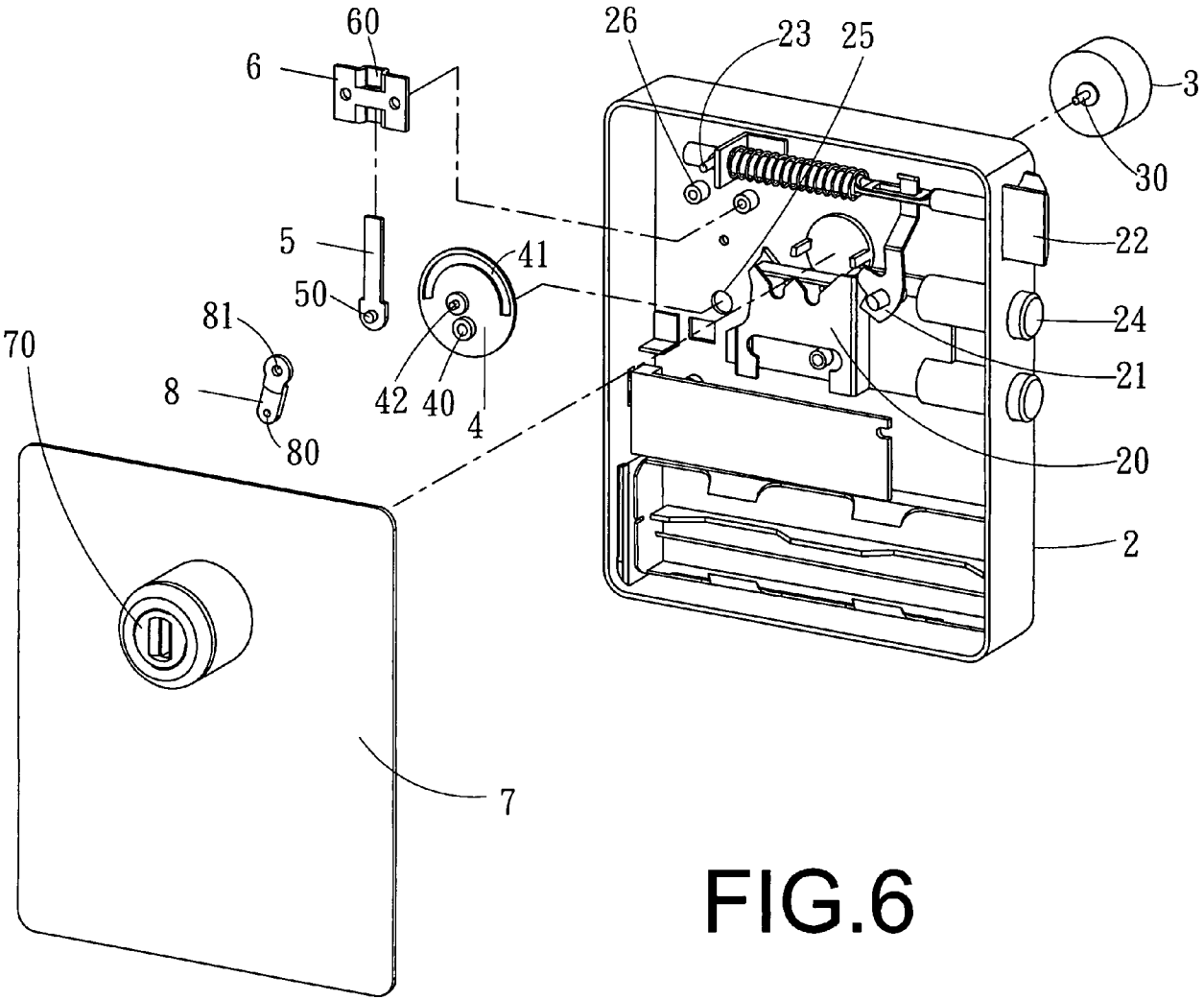
FIG. 6 is an exploded perspective view of a second preferred embodiment of a remote-controlled door lock in the present invention.

A second preferred embodiment of a remote-controlled burglary preventing door lock in the present invention, as shown in FIG. 6, includes a lock shell 2, a motor 3, a cam disk 4, a connecting rod 8, a blocking pin 5, a fixing member 6 and a cover 7 as main components combined together.

The lock shell 2 is provided inside with an interacting member 20 having a push plate 21 fixed thereon. The push plate 21 has its upper end connected with a deadbolt 22, which has its outer end extending out of the outer sidewall of the lock shell 2 and its inner end secured with a stop rod 23. Further, the lock shell 2 is disposed with two locking rods 24 inside one sidewall and provided with an insert hole 25 and fixing studs 26 in the interior.

The motor 3 is assembled on the outer wall of the lock shell 2, having a spindle 30 inserted through the insert hole 25 of the lock shell 2.

The cam disk 4 positioned in the lock shell 2 is bored with a shaft hole 40 and an arc-shaped slide groove 41 and provided with a projection 42.

The connecting rod 8 has one end pivotally connected to the cam disk 4 and has its opposite ends respectively bored with an insert hole 80, 81.

The blocking pin 5 is pivotally connected with the other end of the connecting rod 8, having its lower end formed with a projecting stud 50.

The fixing member 6 is firmly assembled on the fixing studs 26 in the lock shell 2, having a vertical insert slot 60 for the blocking pin 5 to be inserted therethrouugh.

The cover 7 to be assembled on the lock shell 2 is provided with a lock core 70.

Figure 7:
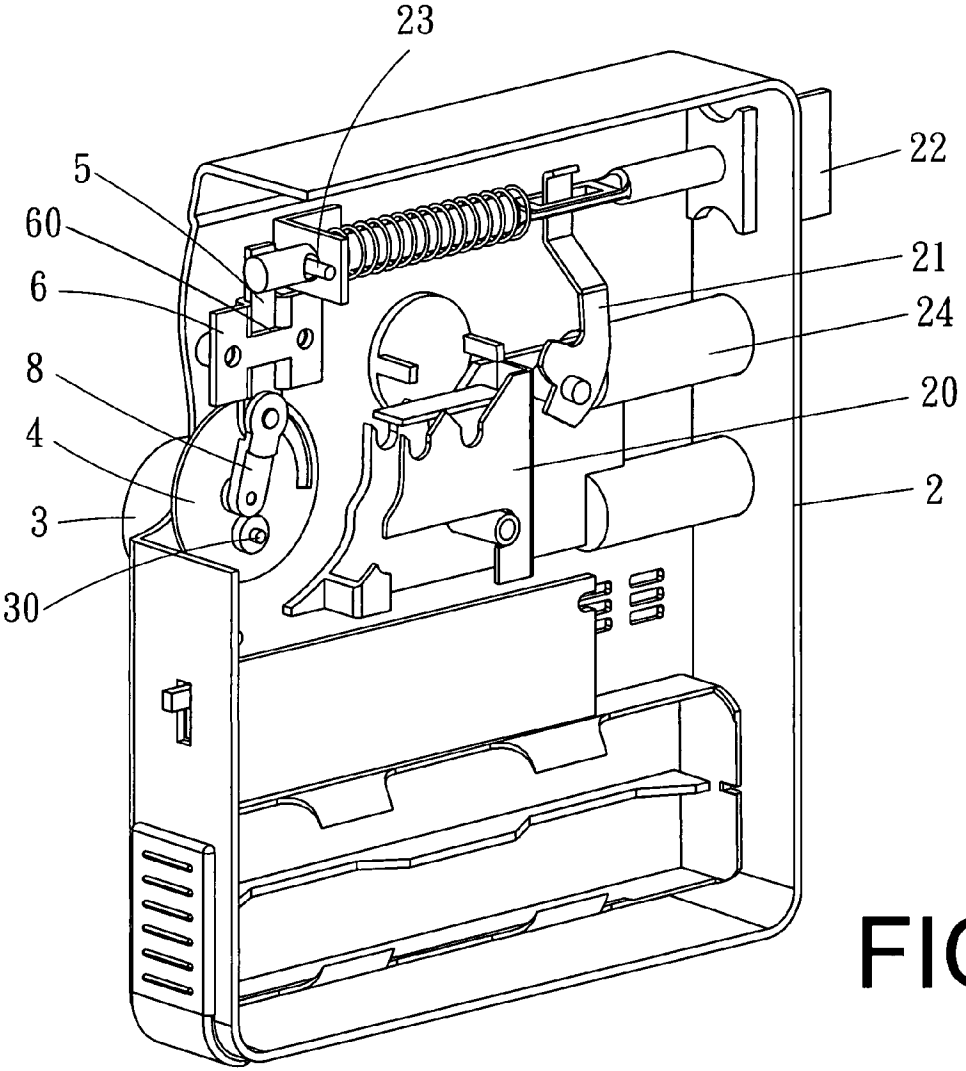
FIG. 7 is a perspective view of the second preferred embodiment of the remote-controlled door lock in the present invention.
Figure 8:
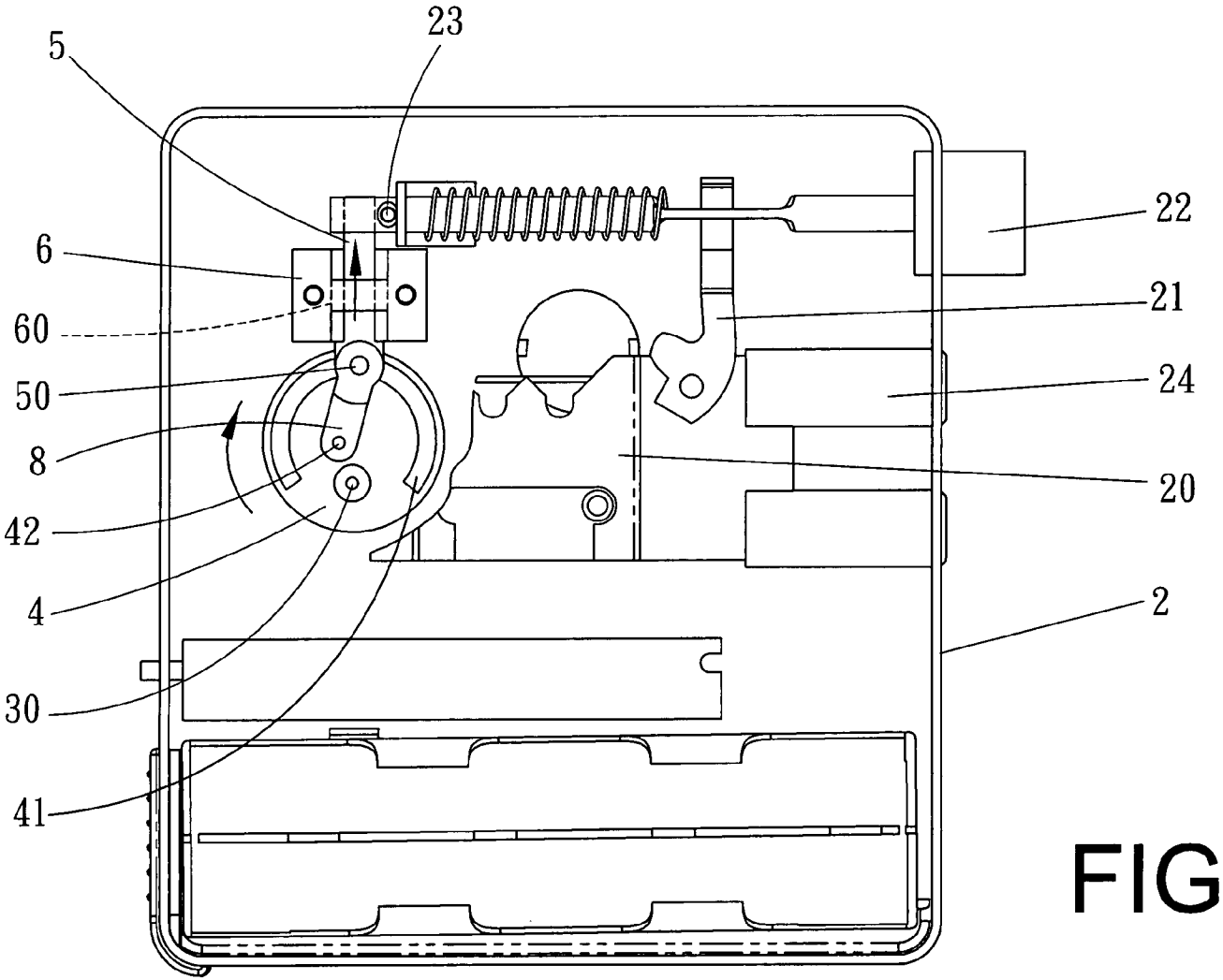
FIG. 8 is a cross-sectional view of the second preferred embodiment of the remote-controlled door lock in a locking condition in the present invention; and, FIG. 9 is a cross-sectional view of the second preferred embodiment of the remote-controlled door lock in an unlocking condition in the present invention.

In assembling, as shown in FIGS. 6, 7 and 8, firstly, the motor 3 is fixed on the outer wall of the lock shell 2, letting the spindle 30 of the motor 3 inserted through the insert hole 25 of the lock shell 2. Next, the cam disk 4 is secured on the spindle 30 in the lock shell 2, and the connecting rod 8 has one end pivotally combined with the projection 42 of the cam disk 4 and the other end pivotally connected with the lower end of the blocking pin 5. Subsequently, the fixing member 6 is secured on the fixing studs 26 in the lock shell 2 and the upper end of the blocking pin 5 is inserted through the vertical insert slot 60 of the fixing member 6. Lastly, the cover 7 is fixed on the lock shell 2 and the lock core 70 of the cover 7 is connected with the connecting member 20, thus finishing assembly of the door lock of the second embodiment.

Figure 9:
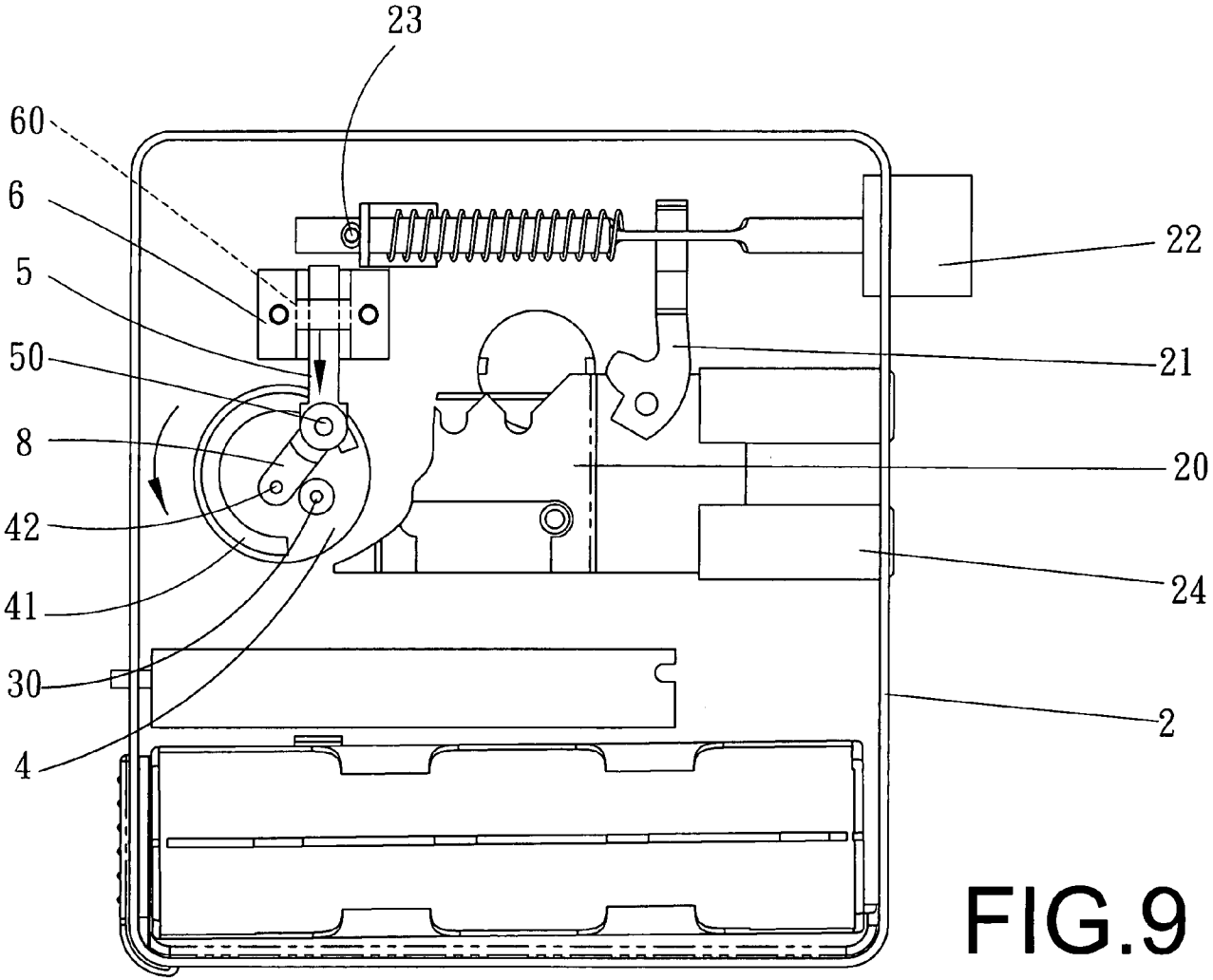

To unlock the door lock of the second embodiment, as shown in FIG. 9, the motor 3 is first started by a remote controller to rotate reversely and drive the cam disk 4 on its spindle 30 to rotate counterclockwise. Synchronously, the connecting rod 8 on the cam disk 4 actuates the blocking pin 5 to moved downward and have its upper end disengaged from the stop rod 23 at the inner end of the deadbolt 22, letting the deadbolt 22 no longer blocked by the blocking pin 5. At this time, a key is inserted in the lock core 70 and turned around to actuate the interacting member 20 to move inward and release the locking rods 24 and simultaneously actuate the push plate 21 to turn and push the dead bolt 22 to retract toward the interior of the lock shell 2, thus finishing unlocking of the door lock.

To lock the door lock of the second embodiment, as shown in FIG. 8, the motor 3 is started by the remote controller to rotate clockwise and drive the cam disk 4 to rotate in the same direction. Synchronously, the connecting rod 8 on the cam disk 4 actuates the blocking pin 5 to move upward to have its upper end blocking the rear side of the stop rod 23 at the inner end of the deadbolt 22, letting the deadbolt 22 blocked by the blocking pin 5 and impossible to retract toward the interior of the lock shell 2. Thus, the door lock is locked and impossible to be unlocked only by a key or by other unlocking tools before it is released by a remote controller, having a best effect of burglary prevention.

While the preferred embodiments of the invention have been described above, it will be recognized and understood that various modifications may made therein and the appended claims are intended to cover all such modification that may fall within the spirit and scope of the invention.

What is claimed is:

1. A remote-controlled burglary preventing door lock comprising:

a lock shell provided with an interacting member in the interior, said interacting member fixed thereon with a push plate, said push plate having its upper end connected with a deadbolt, said deadbolt having its outer end extending out of the outer sidewall of said lock shell, said deadbolt having its inner end secured with a stop rod, said lock shell further provided with an insert hole and fixing studs in the interior;

a motor installed on said lock shell;

a cam disk disposed in said lock shell, said cam disk bored with a shaft hole, said cam disk also bored with an arc-shaped slide groove;

a blocking pin assembled on said cam disk, said blocking pin having its lower end formed with a projecting stud, said projecting stud of said blocking pin inserted in said slide groove of said cam disk;

a fixing member secured on said fixing studs in said lock shell, said fixing member bored with a vertical insert slot for said blocking pin to be inserted therethrough; and, a cover assembled on said lock shell, said cover having a lock core provided thereon.

2. A remote-controlled burglary preventing door lock comprising:

a lock shell provided inside with an interacting member, said interacting member having a push plate fixed thereon, said push plate having its upper end connected with a deadbolt, said deadbolt having its outer end extending out of the outer sidewall of said lock shell, said deadbolt having its inner end secured with a stop rod, said lock shell having two locking rods provided inside one side wall, said lock shell further provided with an insert hole and fixing studs in the interior;

a motor installed on said lock shell;

a cam disk disposed in the interior of said lock shell, said cam disk bored with a shaft hole, said cam disk having a projection fixed thereon;

a connecting rod having one end pivotally connected to said cam disk, said connecting rod having its opposite ends respectively bored with an insert hole;

a blocking pin pivotally connected with the other end of said connecting rod, said blocking pin having its lower end formed with a projecting stud;

a fixing member secured on said fixing studs in said lock shell, said fixing member bored with a vertical insert slot for said blocking pin to be inserted therethrough; and, a cover assembled on said lock shell, said cover having a lock core provided thereon.

* * * * *